US008827113B2

(12) United States Patent
Michelli et al.

(10) Patent No.: US 8,827,113 B2
(45) **Date of Patent: *Sep. 9, 2014**

(54) METHODS AND APPARATUS FOR DISPENSING SOLID ARTICLES

(75) Inventors: Richard D. Michelli, Raleigh, NC (US); Andrew Kirk Dummer, Chapel Hill, NC (US)

(73) Assignee: Parata Systems, LLC, Durham, NC (US)

( * ) Notice: Subject to any disclaimer, the term of this patent is extended or adjusted under 35 U.S.C. 154(b) by 1140 days.

This patent is subject to a terminal disclaimer.

(21) Appl. No.: 12/473,757

(22) Filed: May 28, 2009

(65) Prior Publication Data

US 2009/0294464 A1 Dec. 3, 2009

Related U.S. Application Data

(60) Provisional application No. 61/057,409, filed on May 30, 2008.

(51) Int. Cl.

| | |
|---|---|
| ***B65D 83/04*** | (2006.01) |
| ***G07F 13/10*** | (2006.01) |
| ***G07F 11/44*** | (2006.01) |
| ***G07F 17/00*** | (2006.01) |
| ***G07F 11/62*** | (2006.01) |

(52) U.S. Cl.

CPC ..... *G07F 11/44* (2013.01); *G07F 13/10* (2013.01); *G07F 17/0092* (2013.01); *G07F 11/62* (2013.01)

USPC ..... 221/278; 221/200

(58) Field of Classification Search

USPC ..... 221/200, 278

See application file for complete search history.

(56) References Cited

U.S. PATENT DOCUMENTS

| | | | |
|---|---|---|---|
| 2,578,369 | A | 12/1951 | Noelcke, Sr. |
| 2,665,775 | A | 1/1954 | Smith |

(Continued)

FOREIGN PATENT DOCUMENTS

| | | |
|---|---|---|
| CA | 936 501 | 11/1973 |
| GB | 1 168 758 | 10/1969 |

(Continued)

OTHER PUBLICATIONS

Office Action for corresponding Canadian Application No. 2,667,729 mailed Dec. 29, 2011 (3 pages).

*Primary Examiner* — Gene Crawford
*Assistant Examiner* — Kelvin L Randall, Jr.
(74) *Attorney, Agent, or Firm* — Myers Bigel Sibley & Sajovec

(57) ABSTRACT

An apparatus for dispensing articles includes a housing, a gas source, a drive mechanism and an agitation jet device. The housing defines: a hopper chamber to hold the articles; a dispensing channel fluidly connected to the hopper chamber, the dispensing channel having an inlet and an outlet and defining a flow path therebetween; and an agitation outlet. The gas source provides a positive pressure supply gas flow having a first pressure, a first velocity and a first mass flow rate. The drive mechanism conveys articles through the dispensing channel along the flow path. The agitation jet device is interposed and fluidly connected between the gas source and the agitation outlet. The agitation jet device includes a feed opening to receive the supply gas flow and a jet opening to convert the supply gas flow to a pressurized agitation gas flow through the agitation outlet to agitate articles in the hopper chamber. The agitation gas flow has a second pressure less than the first pressure, a second velocity greater than the first velocity, and a second mass flow rate greater than the first mass flow rate.

16 Claims, 16 Drawing Sheets

(56) References Cited

U.S. PATENT DOCUMENTS

| | | | | |
|---|---|---|---|---|
| 2,708,996 | A | 5/1955 | Skillman | |
| 2,865,532 | A | 12/1958 | Smith | |
| 3,023,851 | A | 3/1962 | Stiller | |
| 3,144,958 | A | 8/1964 | Gumpertz | |
| 3,160,793 | A | 12/1964 | Colburn | |
| 3,179,288 | A | 4/1965 | Davy | |
| 3,185,851 | A | 5/1965 | D'Emilio | |
| 3,196,276 | A | 7/1965 | Naab | |
| 3,206,062 | A | 9/1965 | Rappaport | |
| 3,310,199 | A | 3/1967 | Roberts | |
| 3,312,372 | A | 4/1967 | Cooper, Jr. | |
| 3,410,450 | A | 11/1968 | Fortenberry | |
| 3,417,542 | A | 12/1968 | Merrill | |
| 3,436,736 | A | 4/1969 | Platt | |
| 3,556,342 | A | 1/1971 | Guarr | |
| 3,599,152 | A | 8/1971 | Williams | |
| 3,653,176 | A | 4/1972 | Gess | |
| 3,674,040 | A | 7/1972 | Howells et al. | |
| 3,730,388 | A | 5/1973 | Bender | |
| 3,732,544 | A | 5/1973 | Obland | |
| 3,780,907 | A | 12/1973 | Colburn | |
| 3,815,780 | A | 6/1974 | Bauer | |
| 3,837,139 | A | 9/1974 | Roseberg | |
| 3,885,702 | A | 5/1975 | Joslin | |
| 3,917,045 | A | 11/1975 | Williams | |
| 4,045,276 | A | 8/1977 | Zodrow | |
| 4,223,751 | A | 9/1980 | Ayers et al. | |
| 4,267,942 | A | 5/1981 | Wick | |
| 4,434,602 | A | 3/1984 | Culpepper | |
| 4,546,901 | A | 10/1985 | Buttarazzi | |
| 4,548,336 | A | 10/1985 | Dove | |
| 4,573,606 | A | 3/1986 | Lewis | |
| 4,655,026 | A | 4/1987 | Wigoda | |
| 4,664,289 | A | 5/1987 | Shimizu | |
| 4,674,259 | A | 6/1987 | Hills | |
| 4,674,651 | A | 6/1987 | Scidmore | |
| 4,693,057 | A | 9/1987 | Rittinger | |
| 4,695,954 | A | 9/1987 | Rose | |
| 4,741,428 | A | 5/1988 | Taniguchi et al. | |
| 4,766,542 | A | 8/1988 | Pilarczyk | |
| 4,767,023 | A | 8/1988 | Hackmann et al. | |
| 4,801,044 | A * | 1/1989 | Kubota et al. | 221/163 |
| 4,805,377 | A | 2/1989 | Carter | |
| 4,869,392 | A | 9/1989 | Moulding, Jr. | |
| 4,913,315 | A | 4/1990 | Wagner | |
| 4,918,604 | A | 4/1990 | Baum | |
| 4,953,749 | A | 9/1990 | Kubota et al. | |
| 4,971,513 | A | 11/1990 | Bergerioux | |
| 4,980,292 | A | 12/1990 | Elbert | |
| 4,984,709 | A | 1/1991 | Weinstein | |
| 5,018,644 | A | 5/1991 | Hackmann | |
| 5,047,948 | A | 9/1991 | Turner | |
| 5,289,921 | A | 3/1994 | Rodrigo et al. | |
| 5,337,919 | A | 8/1994 | Spaulding et al. | |
| 5,385,434 | A | 1/1995 | Quinn et al. | |
| 6,003,753 | A | 12/1999 | Hwang et al. | |
| 6,006,946 | A | 12/1999 | Williams et al. | |
| 6,036,812 | A | 3/2000 | Williams et al. | |
| 6,039,512 | A | 3/2000 | Chooi et al. | |
| 6,116,821 | A | 9/2000 | Teoh et al. | |
| 6,176,392 | B1 | 1/2001 | Williams et al. | |
| RE37,829 | E | 9/2002 | Charhut | |
| 6,443,326 | B1 | 9/2002 | Saito et al. | |
| 6,484,902 | B1 * | 11/2002 | Rouse | 221/278 |
| 6,631,826 | B2 | 10/2003 | Pollard et al. | |
| 6,736,286 | B2 | 5/2004 | Hashimoto et al. | |
| 6,971,541 | B2 | 12/2005 | Williams et al. | |
| 2004/0004085 | A1 | 1/2004 | Williams et al. | |
| 2004/0159669 | A1 | 8/2004 | Pollard et al. | |
| 2006/0006189 | A1 | 1/2006 | Curtolo et al. | |
| 2006/0006190 | A1 | 1/2006 | Janet et al. | |
| 2006/0241807 | A1 | 10/2006 | Daniels et al. | |
| 2008/0283549 | A1 * | 11/2008 | Dummer et al. | 221/174 |

FOREIGN PATENT DOCUMENTS

| | | |
|---|---|---|
| GB | 1 411 951 | 10/1975 |
| GB | 2 244 481 A | 12/1991 |
| JP | 51-000792 B4 | 1/1976 |
| JP | 52-047400 A2 | 4/1977 |
| JP | 61-104904 | 5/1986 |
| JP | 63-208410 | 8/1988 |
| JP | 64-028102 | 1/1989 |
| JP | 1-288265 | 11/1989 |
| JP | 2-028417 | 1/1990 |

* cited by examiner

METHODS AND APPARATUS FOR DISPENSING SOLID ARTICLES

RELATED APPLICATION(S)

This application claims the benefit of and priority from U.S. Provisional Patent Application Ser. No. 61/057,409, filed May 30, 2008, the disclosure of which is incorporated herein by reference in its entirety.

FIELD OF THE INVENTION

The present invention is directed generally to the dispensing of solid pharmaceutical articles and, more specifically, is directed to the automated dispensing of solid pharmaceutical articles.

BACKGROUND OF THE INVENTION

Pharmacy generally began with the compounding of medicines which entailed the actual mixing and preparing of medications. Heretofore, pharmacy has been, to a great extent, a profession of dispensing, that is, the pouring, counting, and labeling of a prescription, and subsequently transferring the dispensed medication to the patient. Because of the repetitiveness of many of the pharmacist's tasks, automation of these tasks has been desirable.

One automated system for dispensing pharmaceuticals is described in some detail in U.S. Pat. No. 6,971,541 to Williams et al. This system has the capacity to select an appropriate vial, label the vial, fill the vial with a desired quantity of a selected pharmaceutical tablet, apply a cap to the filled vial, and convey the labeled, filled, capped vial to an offloading station for retrieval. Although this particular system can provide automated pharmaceutical dispensing, it may be desirable to modify certain aspects of the system to address particular needs.

SUMMARY OF THE INVENTION

According to embodiments of the present invention, an apparatus for dispensing articles includes a housing, a gas source, a drive mechanism and an agitation jet device. The housing defines: a hopper chamber to hold the articles; a dispensing channel fluidly connected to the hopper chamber, the dispensing channel having an inlet and an outlet and defining a flow path therebetween; and an agitation outlet. The gas source provides a positive pressure supply gas flow having a first pressure, a first velocity and a first mass flow rate. The drive mechanism conveys articles through the dispensing channel along the flow path. The agitation jet device is interposed and fluidly connected between the gas source and the agitation outlet. The agitation jet device includes a feed opening to receive the supply gas flow and a jet opening to convert the supply gas flow to a pressurized agitation gas flow through the agitation outlet to agitate articles in the hopper chamber. The agitation gas flow has a second pressure less than the first pressure, a second velocity greater than the first velocity, and a second mass flow rate greater than the first mass flow rate.

According to method embodiments of the present invention, a method for dispensing articles using an apparatus including a housing defining a hopper chamber to hold the articles, a dispensing channel fluidly connected to the hopper chamber, and an agitation outlet, the apparatus further including a gas source, a drive mechanism, and an agitation jet device interposed and fluidly connected between the gas source and the agitation outlet includes: providing a positive pressure supply gas flow from the gas source to a feed opening of the agitation jet device, the supply gas flow having a first pressure, a first velocity and a first mass flow rate; using a jet opening of the agitation jet device, converting the supply gas flow to a pressurized agitation gas flow through the agitation outlet to agitate articles in the hopper chamber, the agitation gas flow having a second pressure less than the first pressure, a second velocity greater than the first velocity, and a second mass flow rate greater than the first mass flow rate; and conveying the articles through the dispensing channel along the flow path using the drive mechanism.

Further features, advantages and details of the present invention will be appreciated by those of ordinary skill in the art from a reading of the figures and the detailed description of the preferred embodiments that follow, such description being merely illustrative of the present invention.

DETAILED DESCRIPTION OF EMBODIMENTS OF THE INVENTION

Figure 1:
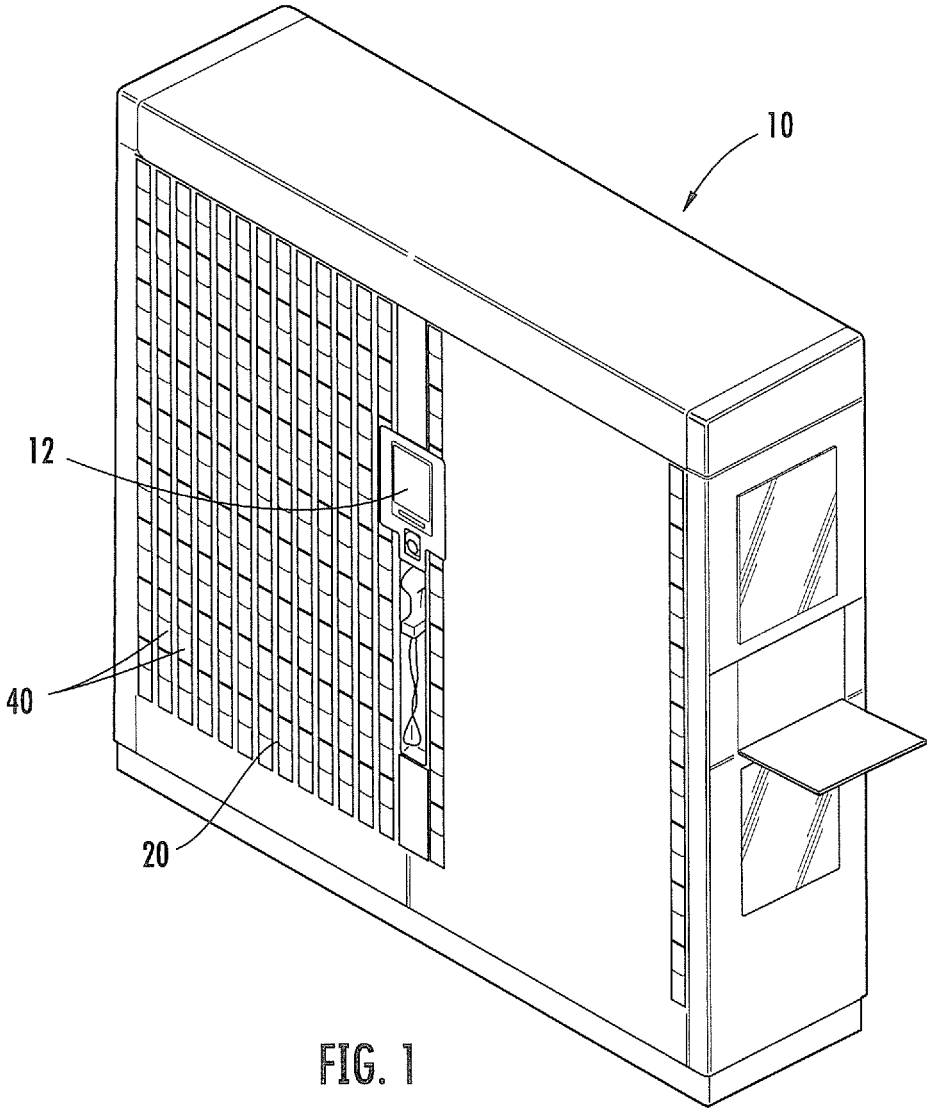
FIG. 1 is a front perspective view of a pharmaceutical tablet dispensing system according to embodiments of the present invention.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In accordance with embodiments of the present invention, apparatus and methods are provided for dispensing solid articles. In particular, such methods and apparatus may be used to dispense pharmaceutical articles. According to some embodiments, the articles are pharmaceutical tablets or pills.

Figure 2:
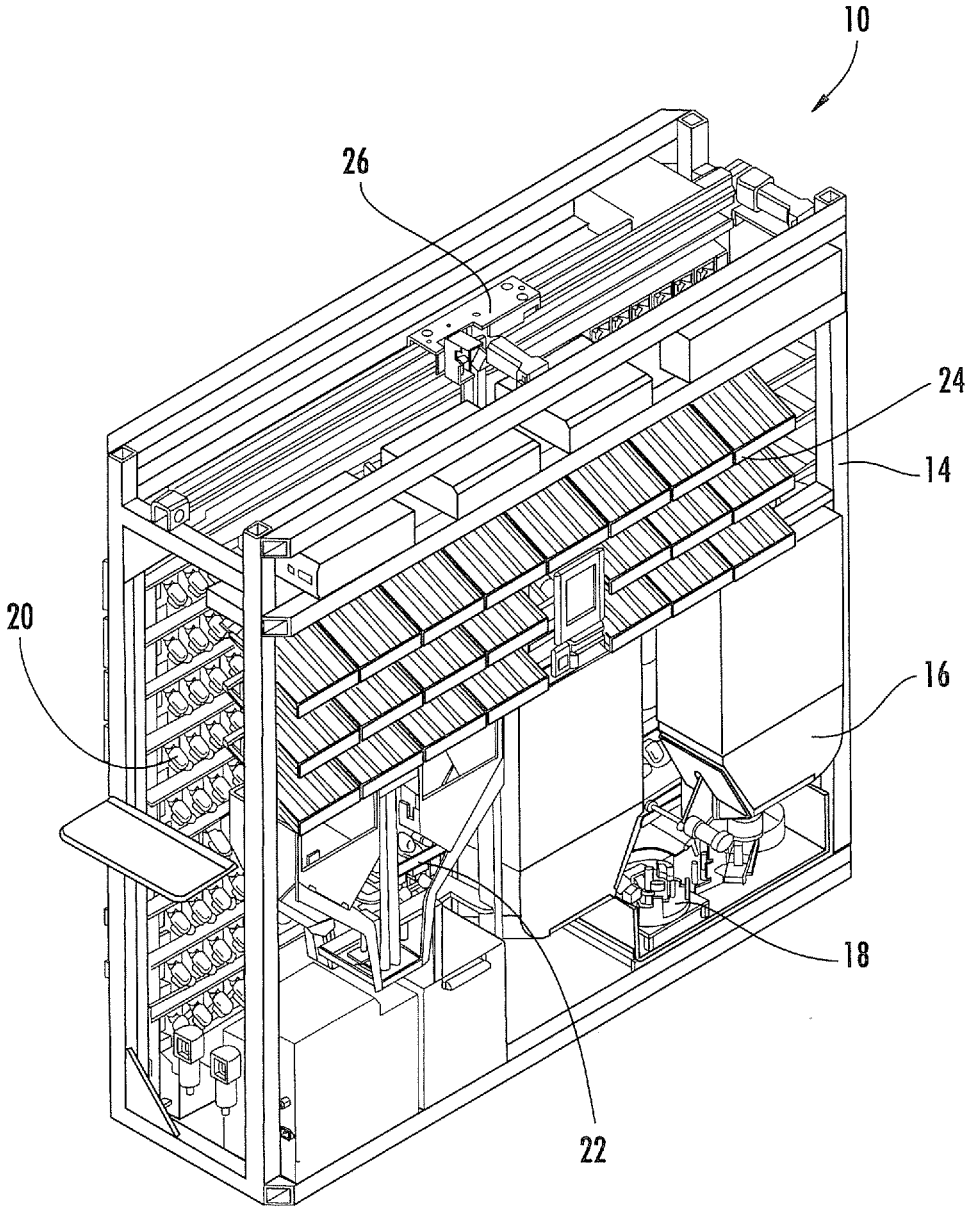
FIG. 2 is a cutaway, rear perspective view of the tablet dispensing system of FIG. 1 illustrating a container dispensing station, a labeling carrier, a dispensing carrier, and a closure dispensing station thereof.

A dispensing system according to embodiments of the present invention is illustrated in FIGS. 1-14 and designated broadly therein at 10 (FIGS. 1 and 2). The dispensing system 10 includes a support frame 14 for the mounting of its various components. Those skilled in this art will recognize that the frame 14 illustrated herein is exemplary and can take many configurations that would be suitable for use with the present invention. The frame 14 provides a strong, rigid foundation to which other components can be attached at desired locations, and other frame forms able to serve this purpose may also be acceptable for use with this invention.

The system 10 generally includes as operative stations a controller (represented herein by a graphical user interface 12), a container dispensing station 16, a labeling station 18, a tablet dispensing station 20, a closure station 22, and an offloading station 24. In the illustrated embodiment, containers, tablets and closures are moved between these stations with a dispensing carrier 26; however, in some embodiments, multiple carriers are employed. The dispensing carrier 26 has the capability of moving the container to designated locations within the frame 14. Except as discussed herein with regard to the dispensing station 20, each of the operative stations and the conveying devices may be of any suitable construction such as those described in detail in U.S. Pat. No. 6,971,541 to Williams et al., U.S. Pat. No. 7,344,049, and U.S. patent application Ser. Nos. 11/599,526; 11/599,576; 11/679,850; and 11/111,270, the disclosures of which are hereby incorporated herein in their entireties.

The controller 12 controls the operation of the remainder of the system 10. In some embodiments, the controller 12 will be operatively connected with an external device, such as a personal or mainframe computer, that provides input information regarding prescriptions. In other embodiments, the controller 12 may be a stand-alone computer that directly receives manual input from a pharmacist or other operator. The controller 12 may be distributed with a portion thereof mounted on each bin as described hereinbelow. As used herein, the controller 12 may refer to a central controller and/or a dedicated controller onboard an associated bin. An exemplary controller is a conventional microprocessor-based personal computer.

In operation, the controller 12 signals the container dispensing station 16 that a container of a specified size is desired. In response, the container dispensing station 16 delivers a container to the labeling station 18. The labeling station 18 includes a printer that is controlled by the controller 12. The printer prints and presents an adhesive label that is affixed to the container. The carrier 26 moves the labeled container to the appropriate bin 40 for dispensing of tablets in the container.

Filling of labeled containers with tablets is carried out by the tablet dispensing station 20. The tablet dispensing station 20 comprises a plurality of tablet dispensing bin assemblies or bins 100 (described in more detail below), each of which holds a bulk supply of individual tablets (typically the bins 100 will hold different tablets). The dispensing bins 100, which may be substantially identical in size and configuration, are organized in an array mounted on the rails of the frame 14. Each dispensing bin 100 has a dispensing passage or channel 116 that communicates with a portal or outlet 114A (FIG. 4) that faces generally in the same direction to create an access region for the dispensing carrier 26. The identity of the tablets in each bin is known by the controller 12, which can direct the dispensing carrier 26 to transport the container to the proper bin 100. In some embodiments, the bins 100 may be labeled with a bar code, RFID tag or other indicia to allow the dispensing carrier 26 to confirm that it has arrived at the proper bin 100.

The dispensing bins 100 are configured to singulate, count, and dispense the tablets contained therein, with the operation of the bins 100 and the counting of the tablets being controlled by the controller 12. Some embodiments may employ the controller 12 as the device which monitors the locations and contents of the bins 100; others may employ the controller 12 to monitor the locations of the bins, with the bins 100 including indicia (such as a bar code or electronic transmitter) to identify the contents to the controller 12. In still other embodiments, the bins 100 may generate and provide location and content information to the controller 12, with the result that the bins 100 may be moved to different positions on the frame 14 without the need for manual modification of the controller 12 (i.e., the bins 100 will update the controller 12 automatically).

After the container is desirably filled by the tablet dispensing station 20, the dispensing carrier 26 moves the filled container to the closure dispensing station 22. The closure dispensing station 22 may house a bulk supply of closures and dispense and secure them onto a filled container. The dispensing carrier 26 then moves to the closed container, grasps it, and moves it to the offloading station 24.

Turning to the bins 100 in more detail, an exemplary bin 100 is shown in more detail in FIGS. 3-14. The bin 100 includes a housing 110 having a hopper portion 112 and a nozzle 114. The bin 100 is fluidly connected with a pressurized gas source 136 as discussed in more detail below.

Figure 4:
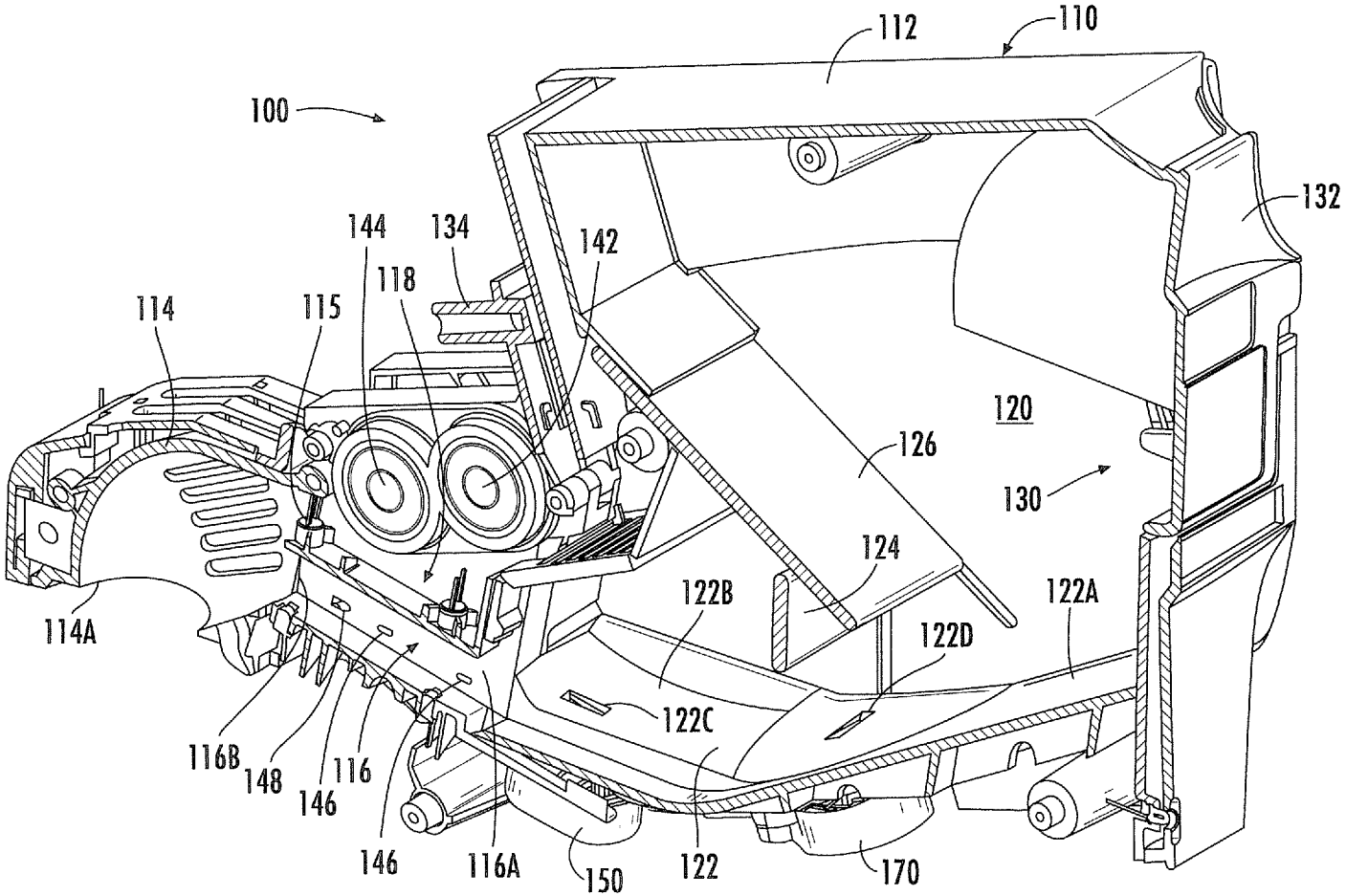
FIG. 4 is a cross-sectional, perspective view of the bin of FIG. 3 taken along the line 4-4 of FIG. 3.
Figure 5:
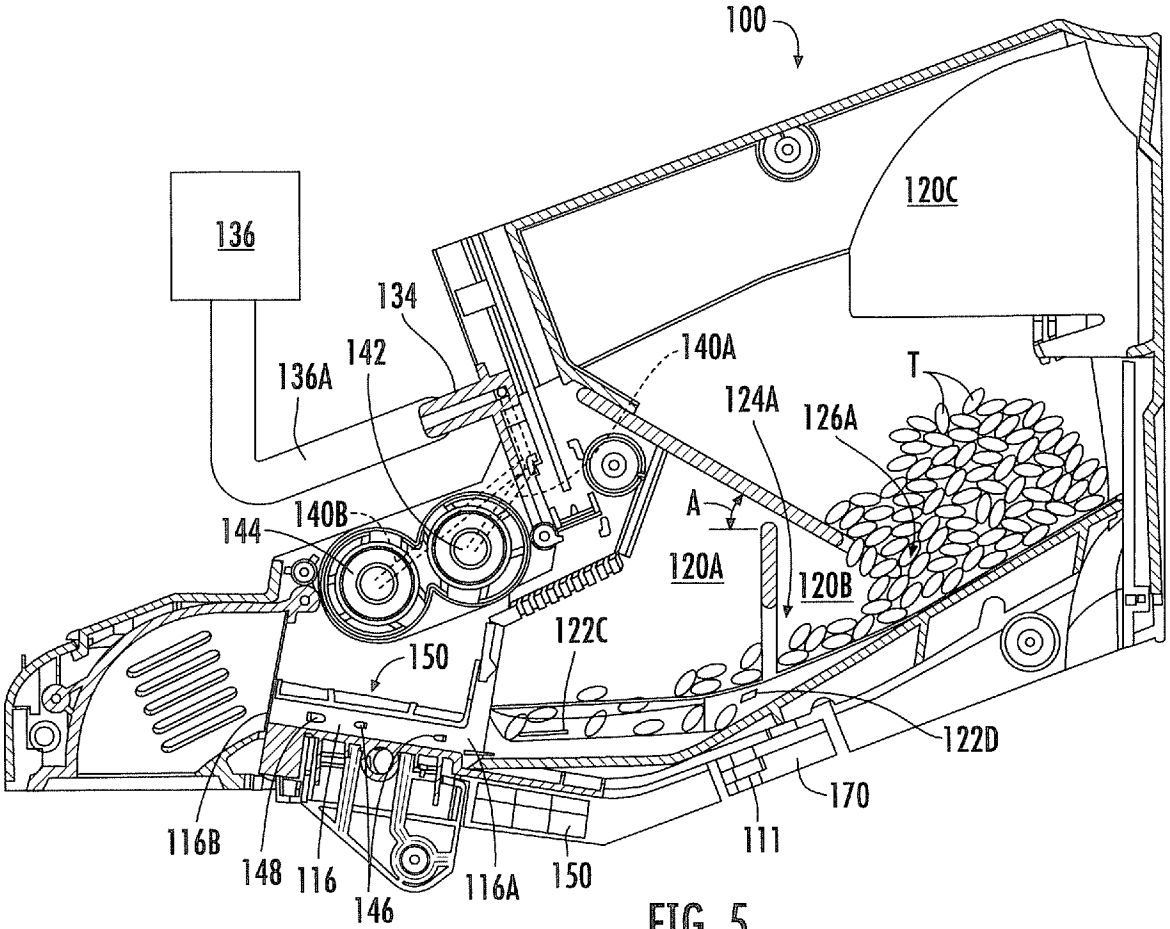
FIG. 5 is a cross-sectional view of the bin of FIG. 3 wherein tablets contained therein are at rest.

Referring to FIGS. 4 and 5, the hopper portion 112 defines a hopper chamber 120 that can be filled with tablets T (FIG. 5). The bin 100 can be filled or replenished with tablets through an opening 130 located at the upper rear portion of the bin 100. The opening 130 is selectively accessible via a pivoting door 132, for example.

The bin 100 further includes an adjustable dispensing channel subassembly 118, only a portion of which is shown in the drawings. The adjustable dispensing channel subassembly 118 may be configured as disclosed in co-assigned U.S. patent application Ser. No. 12/052,301, filed Mar. 20, 2008, the disclosure of which is incorporated herein by reference. According to some embodiments, the heightwise and widthwise dimensions of the dispensing channel 116, the inlet 116A, and the outlet 116B can be selectively configured using the adjustment mechanisms of the adjustable dispensing channel subassembly 118.

With reference to FIG. 4, the hopper portion 112 has a bottom wall defining a floor 122. The floor 122 has a sloped rear portion 122A that slopes downwardly toward the inlet 116A. The floor 122 also has a funnel-shaped front portion 122B. A front agitation port or outlet 122C and a rear agitation port or outlet 122D are provided in the floor 122. As discussed below, air or other pressurized gas can be flowed through the outlets 122C, 122D and into the chamber 120 to agitate the tablets T contained therein.

Figure 3:
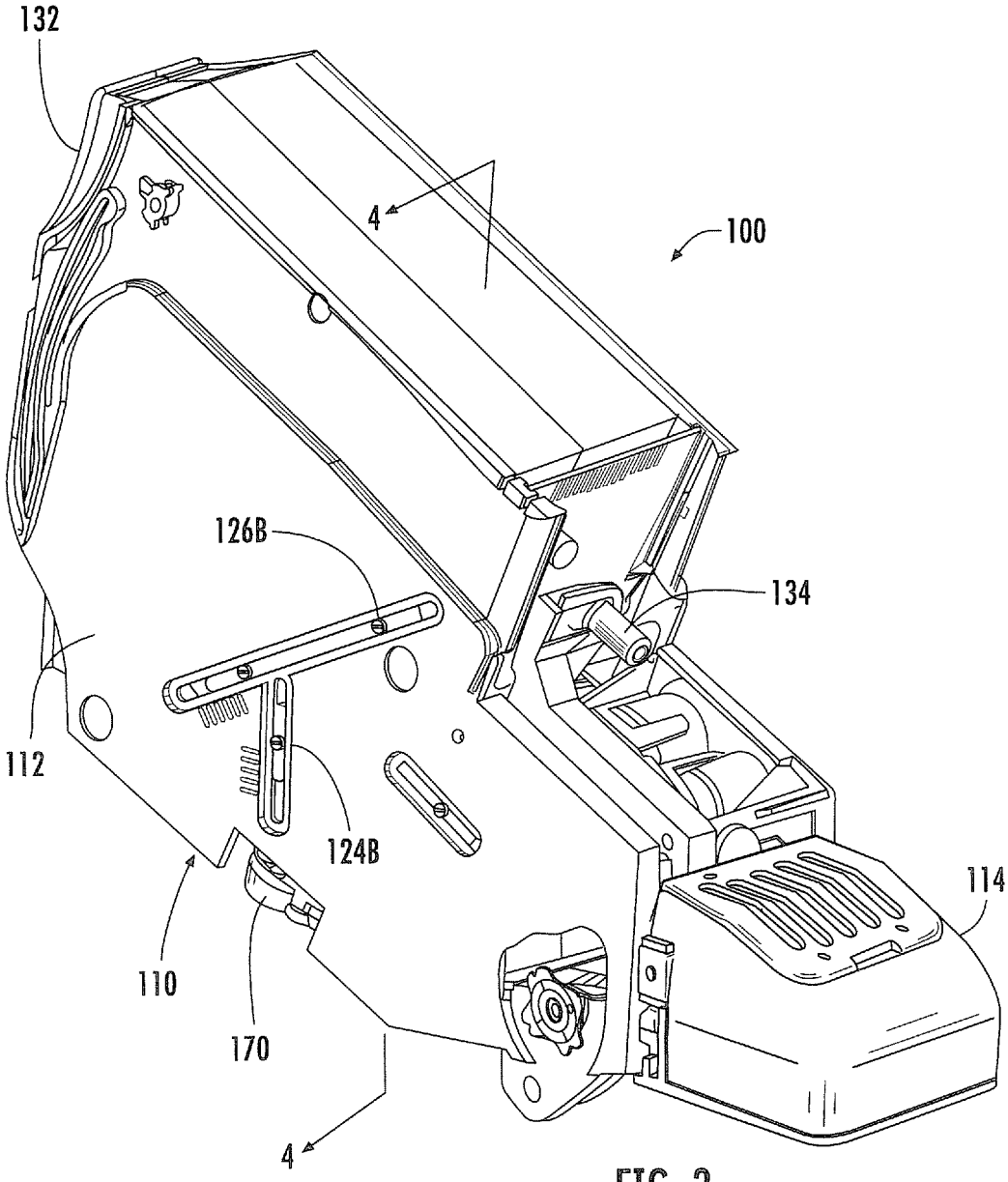
FIG. 3 is a top, front perspective view of a dispensing bin according to embodiments of the present invention and forming a part of the tablet dispensing system of FIG. 1.

With reference to FIG. 5, a front partition or divider wall 124 extends through the hopper chamber 120 and forms a gap or choke point 124A between the lower edge of the wall 124 and the floor 122. According to some embodiments, the choke point 124A has a gap spacing or height of between about 0.25 and 0.75 inch. The position of the wall 124, and thereby the gap spacing, may be selectively adjusted using an adjustment mechanism 124B (FIG. 3).

A rear partition or divider wall 126 extends through the hopper chamber 120 and forms a gap or choke point 126A between the lower edge of the wall 126 and the floor 122. According to some embodiments, the choke point 126A has a gap spacing or height of between about 0.6 and 1 inch. The position of the wall 126, and thereby the gap spacing, may be selectively adjusted using an adjustment mechanism 126B (FIG. 3). According to some embodiments, the rear divider wall 126 forms an angle A (FIG. 5) of at least about 30 degrees with respect to horizontal and, according to some embodiments, between about 30 and 45 degrees with respect to horizontal.

The front divider wall 124 and rear divider wall 126 divide the hopper chamber 120 into subchambers or regions. More particularly and referring to FIG. 5, a front region or subchamber 120A is defined between the divider wall 124 and the inlet 116A, an intermediate region or subchamber 120B is defined between the front divider wall 124 and the rear divider wall 126, and a rear region or subchamber 120C is defined between the rear divider wall 126 and the rear wall of the bin 100.

Figure 8:
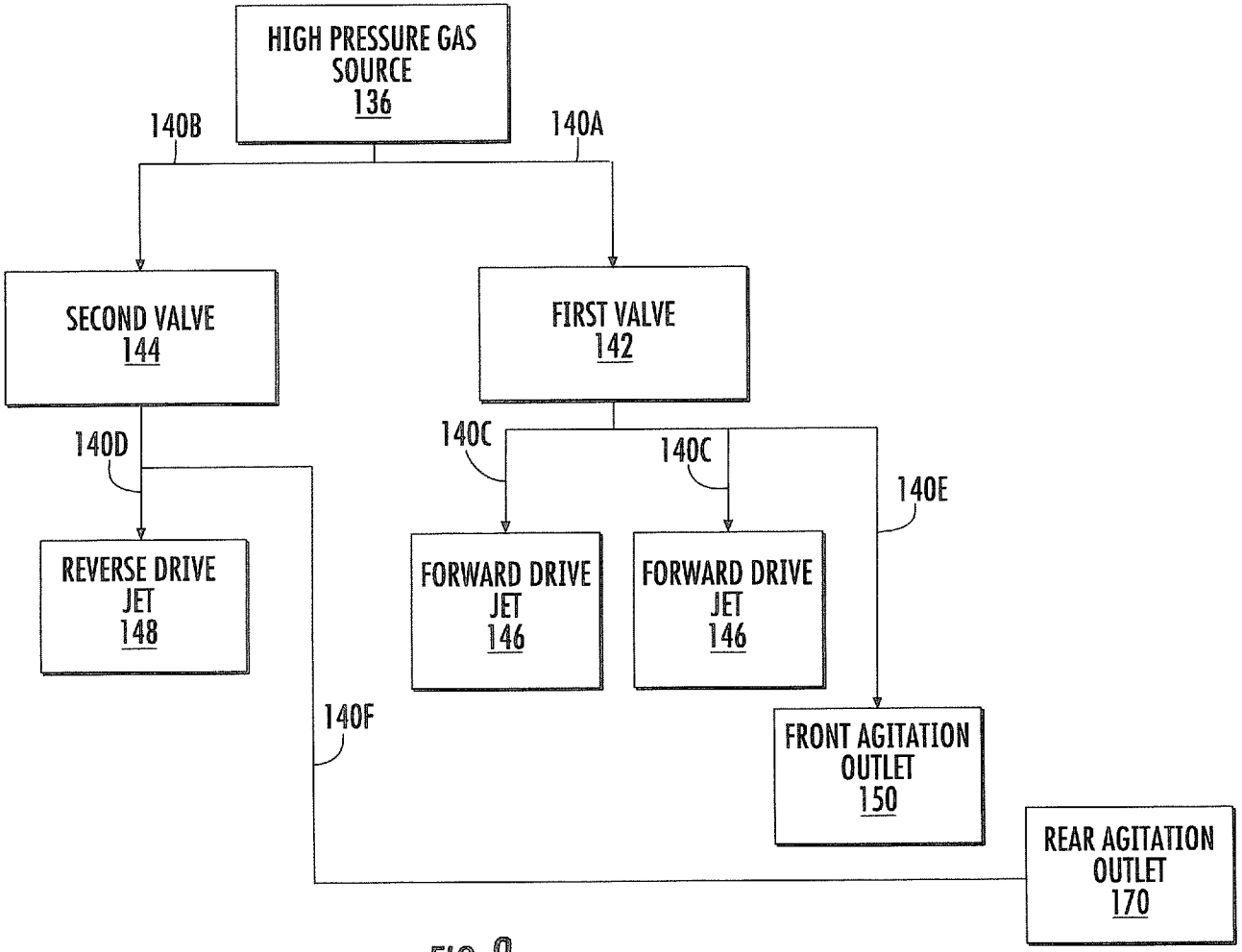
FIG. 8 is a block diagram representing gas supply flow paths of the bin of FIG. 3.
Figure 9:
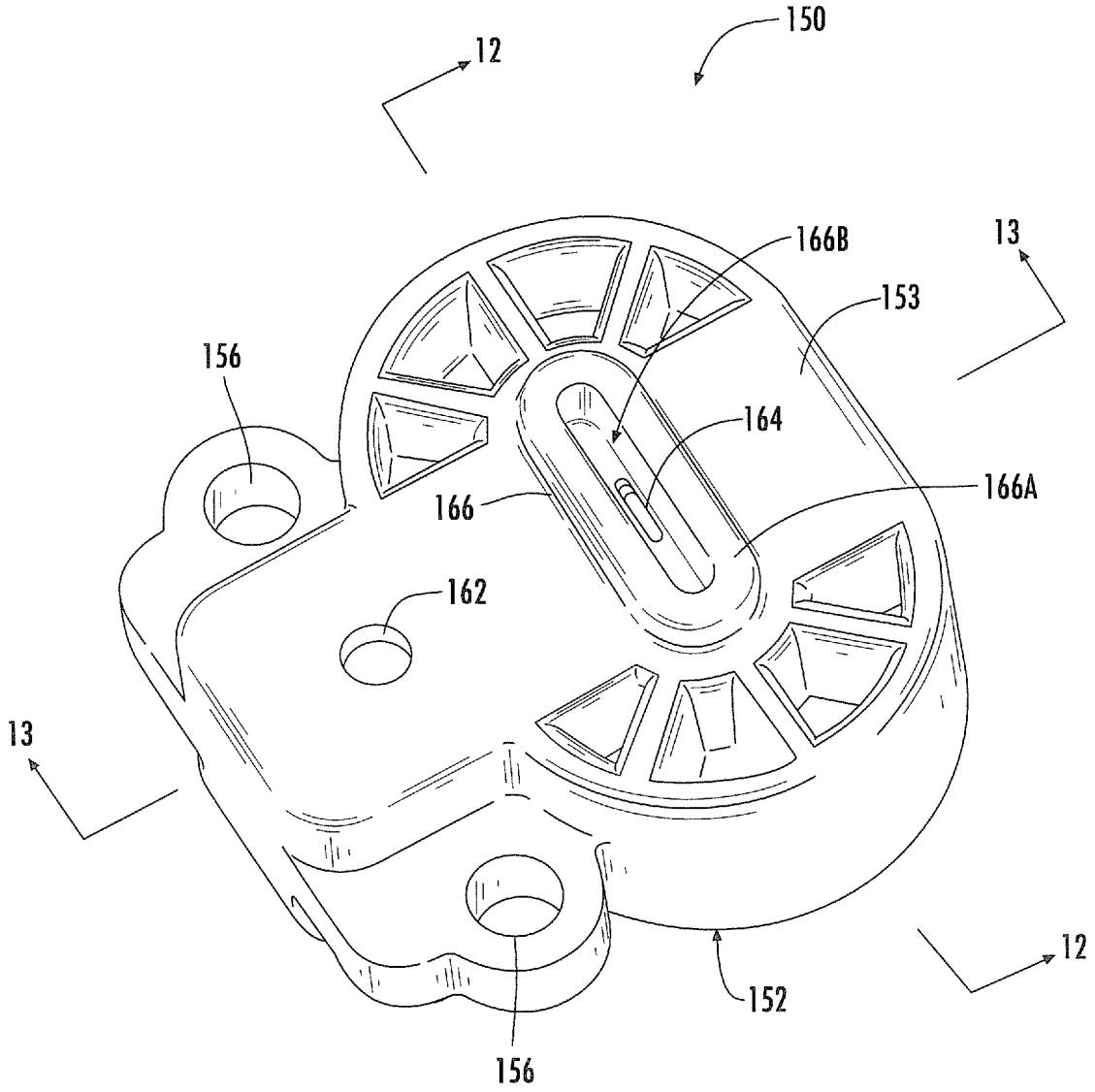
FIG. 9 is a top perspective view of an agitation jet device forming a part of the bin of FIG. 3.

With reference to FIG. 5, the housing 110 further includes a high pressure supply port or nozzle 134. In use, the pressurized gas source 136 is fluidly connected to the high pressure nozzle 134 via a manifold, fitting, flexible or rigid conduit 136A, or the like. The gas source 136 may include a compressor or a container of compressed gas, for example. The high pressure gas source 136 is operative to provide a supply gas flow of a suitable working gas at a high pressure to the nozzle 134. According to some embodiments, the supplied gas is or includes air. According to some embodiments, the pressure of the supplied gas at the nozzle 134 is at least about 10 psi and, according to some embodiments, between about 10 and 60 psi. A flowpath network for the supplied gas is schematically illustrated in FIG. 8 and described below.

Figure 6:
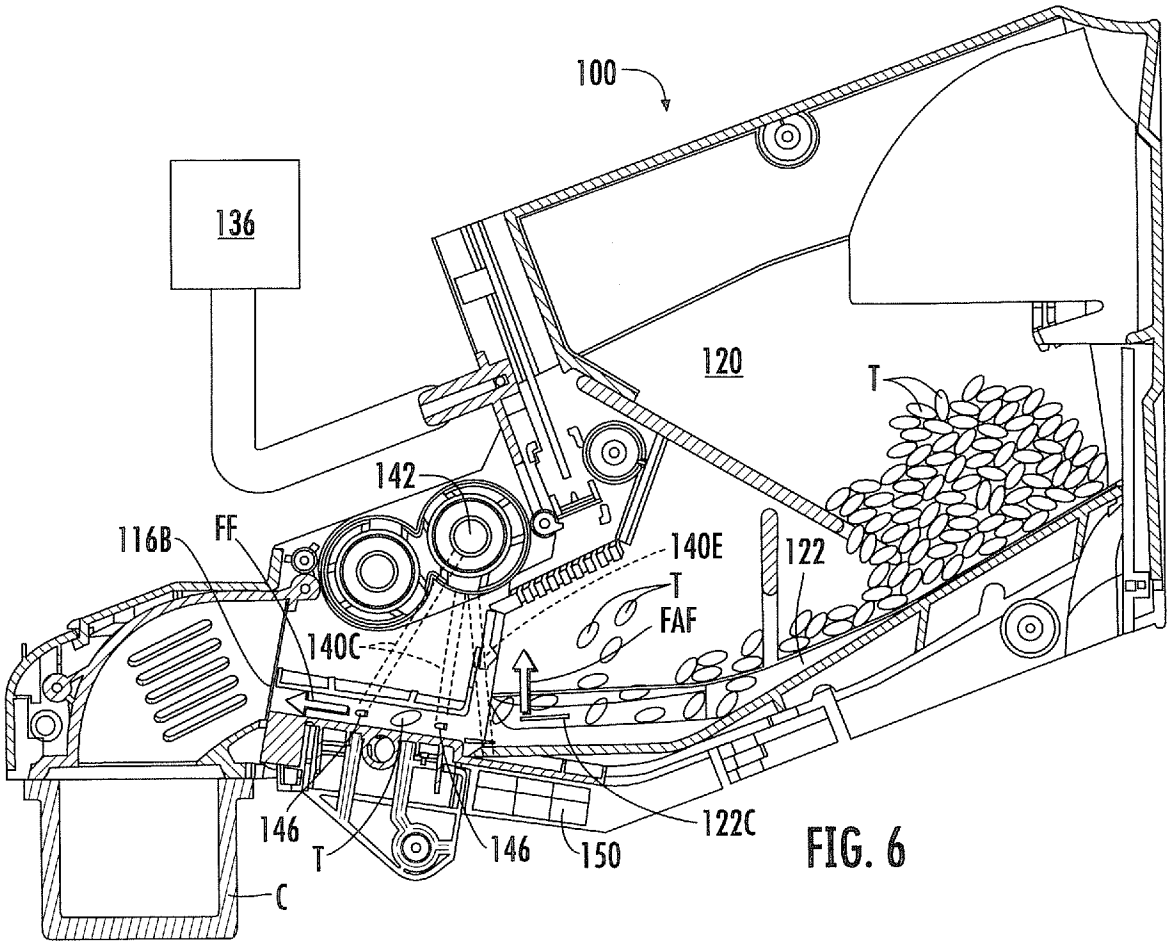
FIG. 6 is a cross-sectional view of the bin of FIG. 3 wherein tablets contained therein are being agitated and dispensed.

With reference to FIGS. 5 and 6, a gas supply passage or conduit 140A (FIG. 5) fluidly connects the high pressure nozzle 134 to a forward control valve 142. Two forward jet supply passages 140C (FIG. 6) fluidly connect the forward control valve 142 to respective forward drive jet apertures or outlets 146. The forward jet outlets 146 are positioned and configured to direct air or other supplied gas into the dispensing channel 116. A front agitation supply passage 140E (FIG. 6) fluidly connects the forward control valve 142 to a front agitation jet device 150. The front agitation jet device 150 is positioned and configured to direct air or other supplied gas into the hopper chamber 120 through the front agitation outlet 122C. The forward control valve 142 is operable to control airflow to the forward jet outlets 146 and the front agitation jet device 150.

Figure 7:
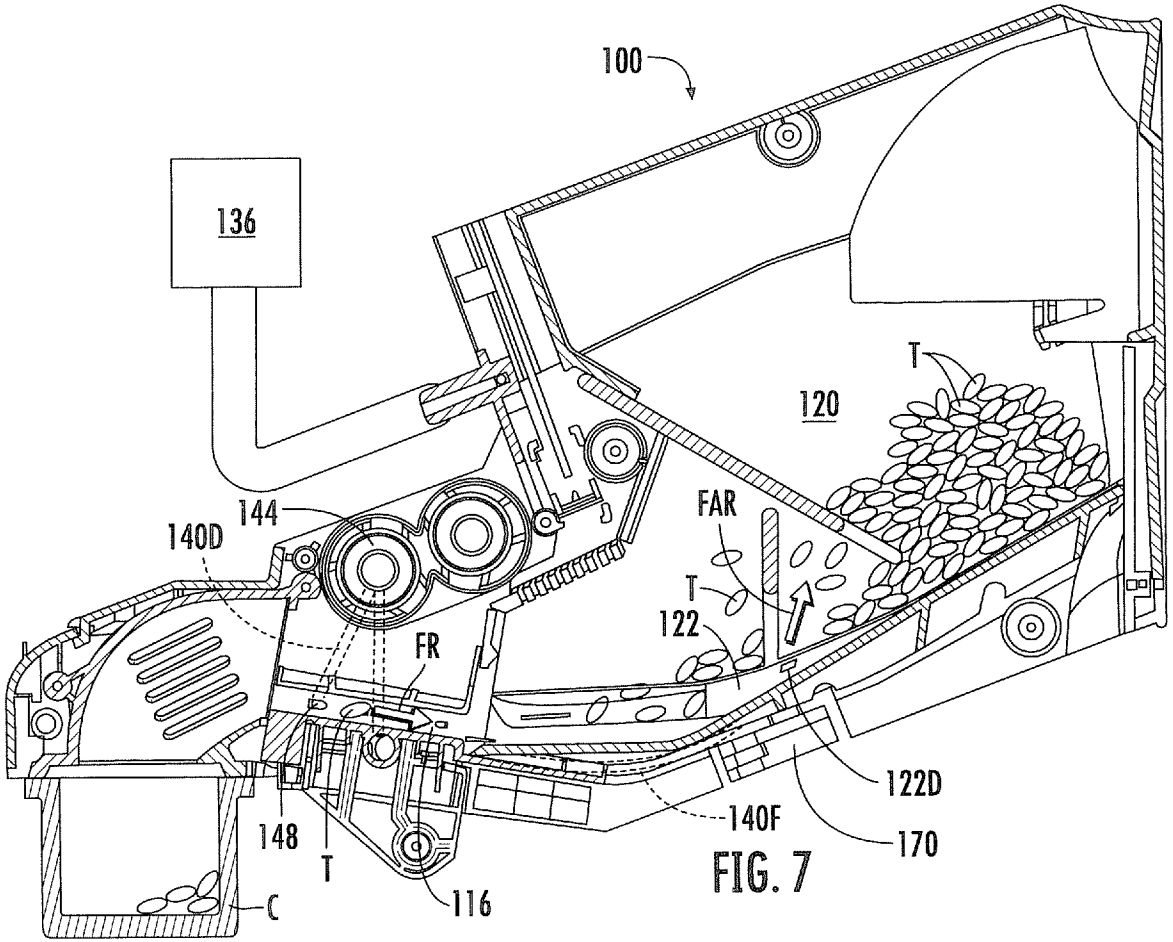
FIG. 7 is a cross-sectional view of the bin of FIG. 3 wherein tablets contained therein are being agitated and returned to a hopper chamber of the bin.

With reference to FIGS. 5 and 7, a gas supply passage or conduit 140B (FIG. 5) fluidly connects the high pressure nozzle 134 to a reverse control valve 144. A reverse jet supply passage 140D (FIG. 7) fluidly connects the reverse control valve 144 to a reverse drive jet aperture or outlet 148. The reverse jet outlet 148 is positioned and configured to direct air or other supplied gas into the dispensing channel 116. A rear agitation supply passage 140F (FIG. 7) fluidly connects the reverse control valve 144 to a rear agitation jet device 170. The rear agitation jet device 170 is positioned and configured to direct air or other supplied gas into the hopper chamber 120 through the rear agitation outlet 122D. The reverse control valve 144 is operable to control airflow to the reverse jet outlet 148 and the rear agitation jet device 170.

The gas supply passages 140A-F may be of any suitable construction and configuration. According to some embodiments, some or all of the passages 140A-F are defined in whole or in part by channels formed in the housing 110. These channels may be machined or molded into the housing 110.

Each of the agitation jet devices 150, 170 is secured to the housing 110. The agitation jet devices 150, 170 may be of any suitable construction to effect the functionality described herein. According to some embodiments, the agitation jet devices 150, 170 are constructed as described below with regard to the agitation jet device 150. The agitation jet devices 150, 170 may be constructed in the same or similar manners and it will therefore be appreciated that this description can likewise apply to the agitation jet device 170 (and/or any additional agitation jet devices).

Figure 10:
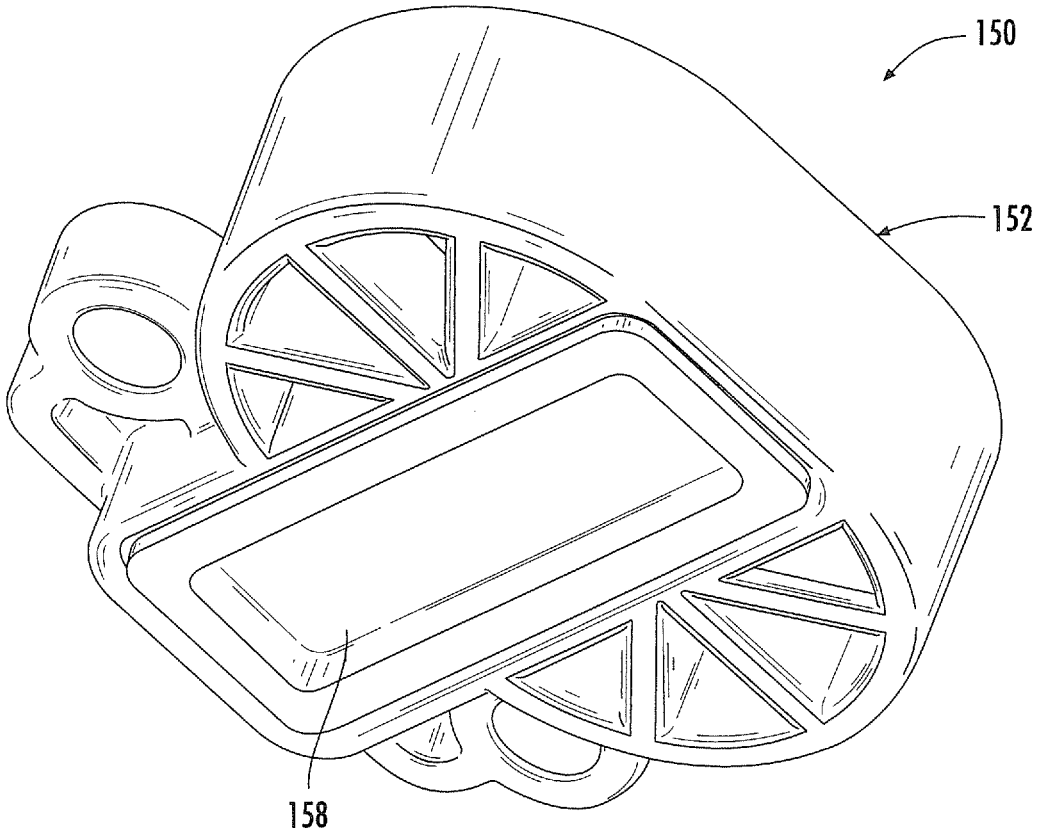
FIG. 10 is a bottom perspective view of the agitation jet device of FIG. 9.
Figure 11:
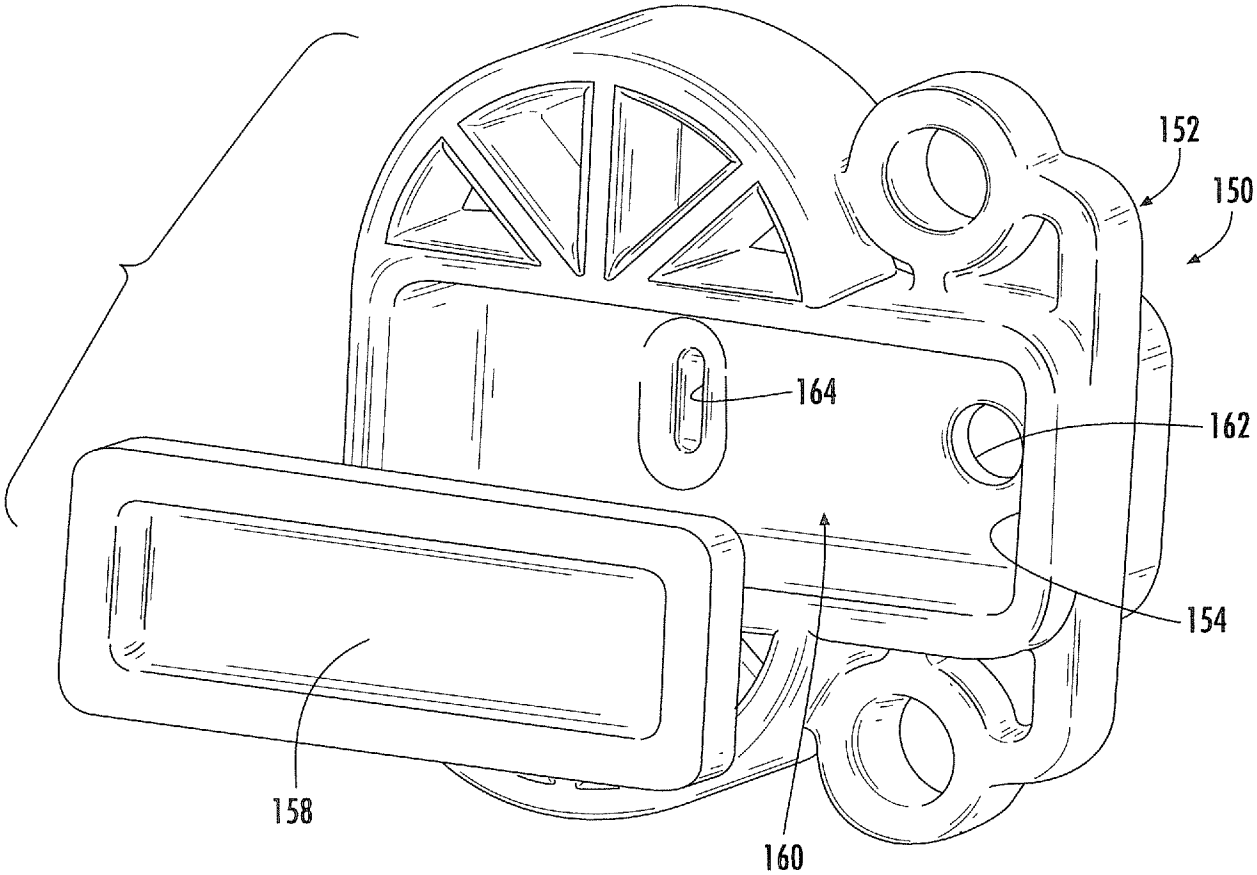
FIG. 11 is an exploded, bottom perspective view of the agitation jet device of FIG. 9.
Figure 12:
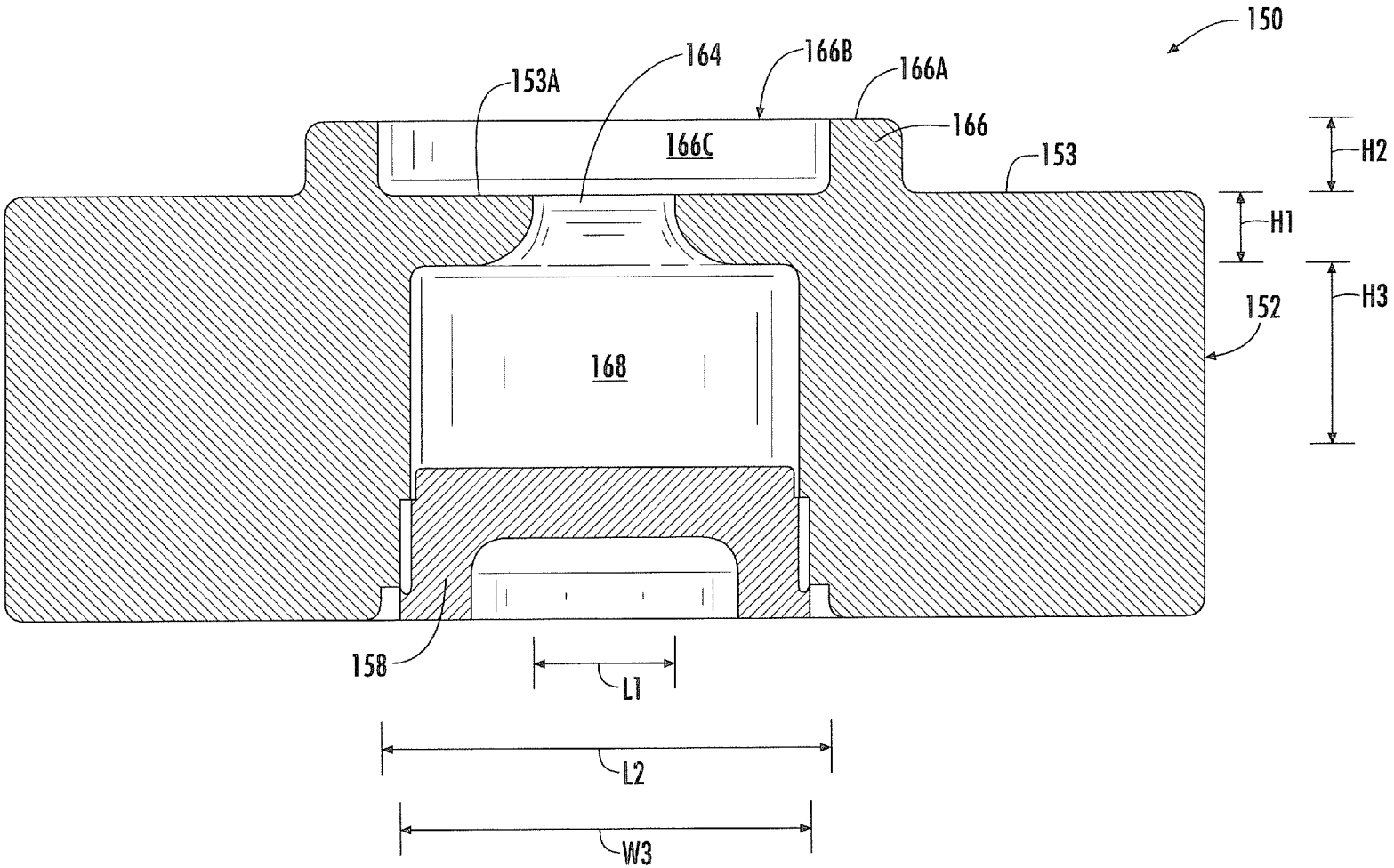
FIG. 12 is a cross-sectional view of the agitation jet device of FIG. 9 taken along the line 12-12 of FIG. 9.
Figure 13:
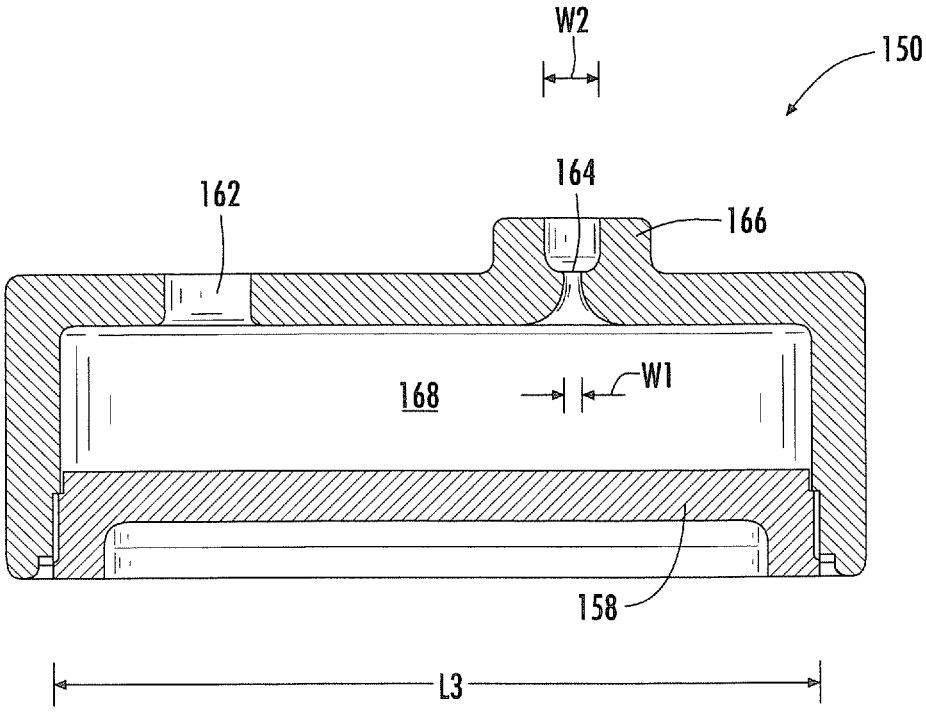
FIG. 13 is a cross-sectional view of the agitation jet device of FIG. 9 taken along the line 13-13 of FIG. 9.

With reference to FIGS. 9-13, the agitation jet device 150 includes a body 152 and a plug member 158 (FIGS. 10 and 11). The body 152 and the plug member 158 may be formed of any suitable material(s). According to some embodiments, the body 152 and the plug member 158 are formed of a rigid polymeric material, which, according to some embodiments, is molded. The body 152 and the plug member 158 may each be unitarily formed as illustrated or may each comprise assembled subcomponents. Moreover, the body 152 and the plug member 158 may be unitarily formed together.

The body 152 includes a top wall 153, a bottom opening 154 (FIG. 11) opposite the top wall 153, and a cavity 160 (FIG. 11) communicating with the opening 154. An inlet or feed opening 162 and an elongated outlet or jet slot 164 are each defined in the wall 153 and each fluidly communicates with the cavity 160. An annular collar or flange 166 extends upwardly from the top wall 153. The flange 166 has a flange upper face 166A and defines a flange opening 166B at the flange upper face 166A. The flange 166 surrounds the jet slot 164. The flange 166 and the portion 153A (FIG. 12) of the top surface 153 collectively define a cavity or exit chamber 166C (FIG. 12) fluidly communicating with the flange opening 166B. Mounting holes 156 are formed in the body 152 to receive fasteners for securing the agitation jet device 150 to the housing 110.

The plug member 158 is seated in the body 152 in or adjacent the opening 154 to close the opening 154. The plug member 158 encloses the cavity 160 to define an interior flow plenum or passage 168 (FIGS. 12 and 13) that fluidly connects the feed opening 162 and the jet slot 164.

When the agitation jet device 150 is installed in the housing 110, the gas supply passage 140E (FIGS. 6 and 14) is fluidly connected to the feed opening 162 to supply the gas from the gas source 136 to the jet slot 164 via the passage 168. Similarly, when the agitation jet device 170 is installed in the housing 110, the gas supply passage 140F (FIG. 7) is fluidly connected to the feed opening of the agitation jet device 170 to supply the gas from the gas source 136 to the jet slot of the agitation jet device 170.

Figure 14:
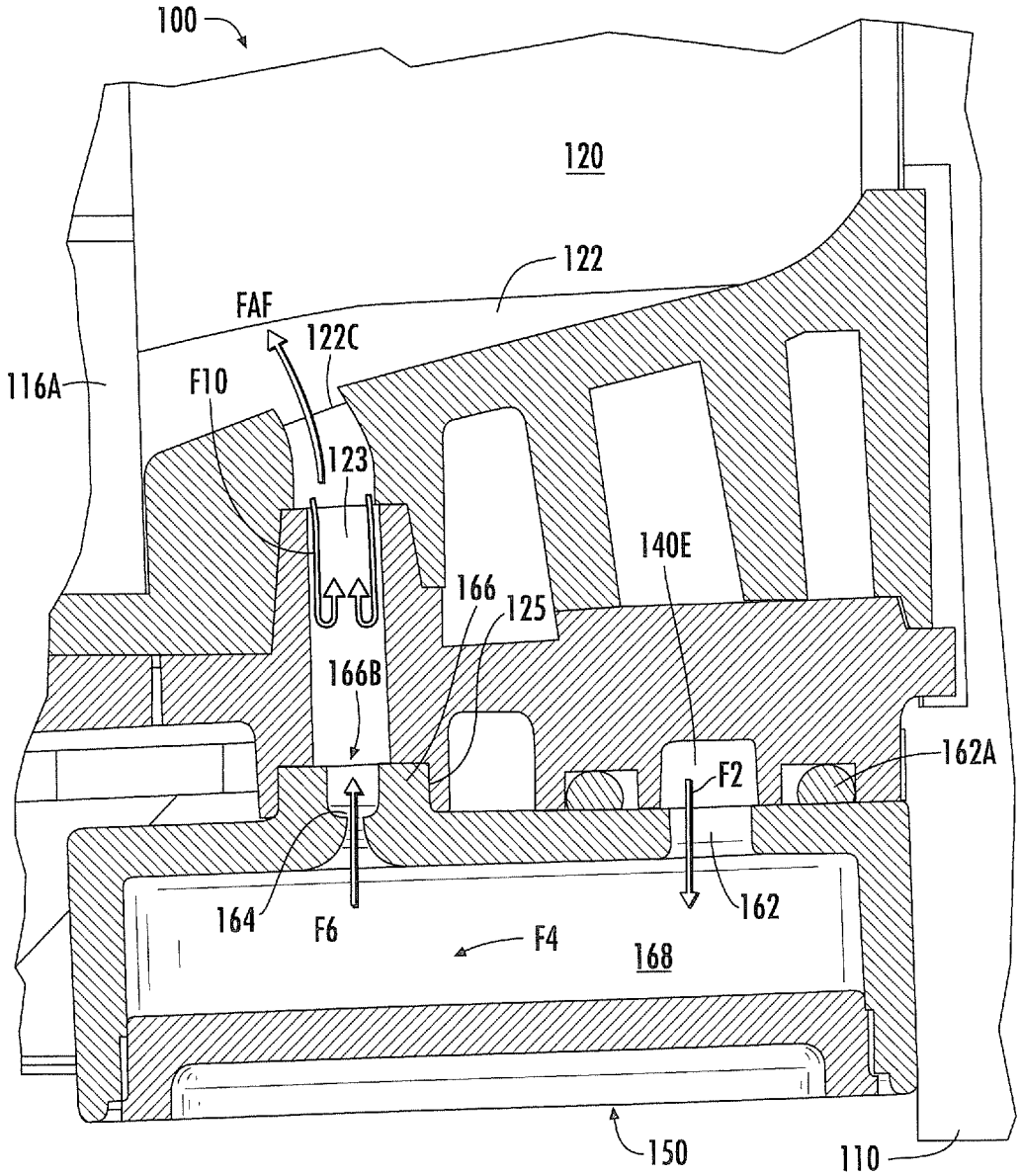
FIG. 14 is an enlarged, fragmentary, cross-sectional view of the bin of FIG. 5.

More particularly and with reference to FIG. 14, the agitation jet device 150 can be secured to the bottom of the housing 110 by fasteners 111 (FIG. 5) through the mount holes 156. The agitation jet device 150 is positioned such that the feed opening 162 interfaces with the gas supply passage 140E and the flange opening 166B interfaces with a duct 123 that terminates at the agitation port 122C. An O-ring 162A can be provided between the housing 110 and the agitation jet device 150 about the feed opening 162 to effect a pressure-tight seal. The flange 166 may be received in a complementary recess 125 in the housing 110. The agitation jet device 170 can be similarly mounted or installed with respect to the gas supply passage 140F and the agitation port 122D.

In use and with reference to FIG. 14, the agitation jet device 150 (and likewise the agitation jet device 170) can be used to convert a supplied pressurized gas flow having a given pressure, velocity and mass flow rate into an exiting or output air flow having a comparatively lower pressure, higher velocity, and higher mass flow rate. More particularly, the valve 142 can be opened to supply a flow of pressurized gas to the passage 168 via the feed opening 162. The supplied gas flows into the passage 168 through the feed opening 162 (as indicated by the arrow F2) and through the passage 168 (as indicated by the arrow F4). The pressurized gas then flows through the jet slot 164 to generate a jet flow F6 directed into the exit chamber 166. In the exit chamber 166 and/or duct 123, the jet flow F6 mixes with a supplemental flow F10 of air drawn from the hopper subchamber 120B to create a combined exit gas flow FAF. More particularly, the high velocity flow of the jet flow F6 may create a low pressure region that draws the ambient air from the hopper subchamber 120B into the exit chamber 166 where the drawn air F10 absorbs energy from and joins the jet flow F6 to provide the exit gas flow FAF. The exit gas flow FAF has a pressure that is less than the pressure of the supplied gas and a mass flow rate that is greater than that of the supplied gas. The exit gas flow FAF enters the hopper chamber 120 through the agitation outlet 122C (FIGS. 6 and 14).

The agitation jet device 170 can operate in the same manner to convert the pressurized gas supplied via the gas supply passage 140F to an exit gas flow FAR, which enters the hopper chamber 120 through the agitation outlet 122D (FIG. 7).

According to some embodiments, the jet slot 164 has a nominal width W1 (FIG. 13) in the range of from about 0.015 to 0.035 inch. According to some embodiments, the jet slot 164 has a length L1 (FIG. 12) in the range of from about 0.075 to 0.150 inch. According to some embodiments, the jet slot 164 has a height H1 (FIG. 12) in the range of from about 0.020 to 0.060 inch. According to some embodiments, the ratio of the length L1 to the width W1 is at least about 6:1 and, according to some embodiments, in the range of from about 10:1 to 1:1. According to some embodiments, the jet slot 164 has a total area in the range of from about 0.002 $in^2$ to 0.004 $in^2$. According to some embodiments, the area of the jet slot 164 is less than the area of the feed opening 162.

According to some embodiments, the exit chamber 166 has a width W2 (FIG. 13) in the range of from about 0.05 to 0.075 inch. According to some embodiments, the exit chamber 166 has a length L2 (FIG. 12) in the range of from about 0.5 to 0.75 inch. According to some embodiments, the exit chamber 166 has a height H2 (FIG. 12) in the range of from about 0.05 to 0.1 inch. According to some embodiments, the exit chamber 166 has a total area in the range of from about 0.15 $in^2$ to 0.3 $in^2$. According to some embodiments, the ratio of the total area of the exit chamber 166 to the total area of the jet slot 164 is at least about 10:1 and, according to some embodiments, in the range of from about 5:1 to 20:1. According to some embodiments, the exit chamber 166 has a total volume in the range of from about 0.001 $in^3$ to 0.002 $in^3$.

According to some embodiments, the passage 168 has a cross-sectional area of sufficient size to ensure that the flow between the feed opening 162 and the jet slot 164 is not restricted. According to some embodiments, the passage 168 has a width W3 (FIG. 13) in the range of from about 0.25 to 0.375 inch. According to some embodiments, the passage 168 has a length L3 (FIG. 13) in the range of from about 0.5 to 1 inch. According to some embodiments, the passage 168 has a height H3 (FIG. 12) in the range of from about 0.1 to 0.2 inch.

According to some embodiments and as illustrated, one or both of the agitation jet devices 150, 170 are mounted on or integrated into the housing 110. The agitation jet devices 150, 170 may be separately formed from the housing 110 and secured to the housing by adhesive, fasteners, integral mechanical structures, or the like. All or a portion of each agitation jet device 150, 170 may be integrally molded into the housing 110. Each agitation jet device 150, 170 can be separately formed from the housing 110 and insert molded into the housing 110.

One or more sensors 115 (FIG. 4) are operatively positioned in the dispensing channel 116. According to some embodiments, the sensors 115 are counting sensors and are operably connected to associated sensor receiver/processor electronics. As further discussed below, the sensors 115 are configured and positioned to detect the tablets T as they pass through the dispensing channel 116. According to some embodiments, the sensors 115 are photoelectric sensors. According to some embodiments, at least one of the sensors includes a photoemitter and the other sensor includes a photodetector that receives photoemissions from the photoemitter of the first sensor. According to some embodiments, the bin 100 includes a sensor system as disclosed in co-assigned U.S. patent application Ser. No. 12/052,301, filed Mar. 20, 2008, the disclosure of which is incorporated herein by reference.

A connector circuit board or other electrical connector may be mounted on the bin 100 to provide an electrical connection between an external controller and a bin-controlling circuit board or other electronic component of the bin 100 for power and data signals from the external controller and the counting sensors 115.

Exemplary operation of the dispensing system 40 will now be described. The bin 100 is filled with tablets T to be dispensed. The tablets T may initially be at rest as shown in FIG. 5. At this time, the valves 142, 144 are closed so that no gas flow is provided through the jet outlets 146, 148 or the agitation outlets 122C, 122D.

When is it desired to dispense the tablets T to fill the container C, the dispensing carrier 70, directed by the controller 12, moves the container C to the exit port 114A of the nozzle 114 of the selected dispensing bin 100. The controller 42 signals the forward valve 142 to open (while the rearward valve 144 remains closed). The opened valve 142 permits the pressurized gas from the gas source 136 to flow through the passages 140C and out through the forward drive jet outlets 146. The pressurized flow from the jet outlets 146 creates high velocity gas jets that generate suction that causes a forward flow FF of high pressure, high velocity air to be drawn outwardly through the dispensing channel 116 (FIG. 6). Tablets T are oriented into a preferred orientation by the shape of the inlet 116A to the dispensing channel 116 and dispensed into the container C through the dispensing channel 116 and the outlet 116B under the force of the forward flow FF. The counting sensors 115 count the tablets T as they pass through a predetermined point in the dispensing channel 116.

The opening of the valve 142 also simultaneously permits the pressurized supply gas from the gas source 136 to flow through the passage 140E, through the front agitation jet device 150 and out through the front agitation outlet 122C as an air flow FAF having a relatively low velocity and high mass flow rate as compared to the gas flow from the jet outlets 146 (FIG. 6). The air flow FAF flows through and lofts or otherwise displaces (i.e., agitates) the tablets T in the front subchamber 120A proximate the inlet 116A. This agitation of the tablets T helps to orient the tablets T for singulated entry into the dispensing channel 116 and to prevent tablet jams. According to some embodiments, the forward jet gas flows and the agitation flow FAF are provided simultaneously.

Once dispensing is complete (i.e., a predetermined number of tablets has been dispensed and counted), the controller 12 activates the forward valve 142 to close and the reverse valve 144 to open. The opened valve 144 permits the pressurized gas from the gas source 136 to flow through the passage 140D and out through the reverse drive jet outlet 148. The pressurized flow from the jet outlet 148 creates a high velocity gas jet that generates suction that causes a reverse (i.e., rearward) flow FR of high pressure air to be drawn inwardly through the dispensing channel 116 toward the chamber 120. In this manner, the airflow is reversed and any tablets T remaining in the channel 116 are returned to the chamber 120 under the force of the reverse flow (FIG. 7).

The opening of the valve 144 also simultaneously permits the pressurized supply gas from the gas source 136 to flow through the passage 140F, through the rear agitation jet device 170 and out through the rear agitation outlet 122D as the air flow FAR which has a relatively low velocity and high mass flow rate as compared to the gas flow from the jet outlet 148 (FIG. 7). The air flow FAR flows through and lofts or otherwise displaces (i.e., agitates) the tablets T in the front subchamber 120A and/or the intermediate subchamber 120B proximate the choke point 124A. This agitation of the tablets T helps to loosen the tablets T to permit return of the tablets T and to prevent or break tablet jams. According to some embodiments, the reverse jet gas flow and the agitation flow FAR are provided simultaneously. According to some embodiments, the reverse valve 144 is opened and then closed after a relatively short period to provide the reverse flow FR and the agitation flow FAR as short bursts.

During a dispensing cycle, the controller 12 may determine that a tablet jam condition is or may be present. Tablets may form a jam at the nozzle inlet 116A, the choke point 124A or the choke point 126A, so that no tablets are sensed passing through the dispensing passage 116 for a prescribed period of time while the forward air flow FF is being generated. In this case, the controller 12 will issue a "backjet" by closing the forward valve 142 and opening the reverse valve 144 as described above for generating the air flows FR, FAR. The air flows FR, FAR may serve to dislodge any jams at the inlet 116A, the choke point 124A, or the choke point 126A as well as to loosen the tablets in the subchamber 120C.

According to some embodiments and as illustrated, the drive jet outlets 146 and the agitation jet device 150 (and/or the drive jet outlet 148 and the agitation jet device 170) are fluidly connected to the pressurized gas source via the same intake (i.e., the nozzle 134). According to some embodiments and as illustrated, only a single gas source 136 is used to supply both the drive jet outlets 146 and the agitation jet device 150 or both the drive jet outlet 148 and the agitation jet device 170. According to some embodiments, a single gas source is used to supply all drive jet outlets and agitation jet devices.

According to some embodiments, the pressure of the gas supplied to the feed opening 162 of each agitation jet device 150, 170 is substantially the same as the pressure of the gas supplied to each drive jet outlet 146, 148.

In the foregoing manner, agitation air flows FAF, FAR can be provided to facilitate effective and reliable dispensation and return of the tablets T. The agitation jet devices 150, 170 may enable effective agitation of tablets in the hopper 120 using a supplied gas flow that would otherwise be insufficient. For example, a compressor having a lower mass flow rate supply capacity may be used for the gas source 136. This may be particularly beneficial where a smaller or quieter compressor may be needed or desired (e.g., in a pharmacy).

Because the air flows FAF, FAR are supplied from a high pressure source suitable to supply the drive jet outlets 146, 148, it is not necessary to provide a separate low pressure, high mass flow rate air supply to perform tablet agitation and, therefore, the associated apparatus (e.g., manifolds, pumps, etc.) can be omitted. Moreover, because the air flows FAF, FAR are supplied from a common (i.e., the same) high pressure gas source 136 as the jets 144, 146, the number of supplies and connections required can be reduced or minimized. As a result, dispensing systems and bins according to embodiments of the present invention may be less expensive and complicated to manufacture and operate.

Aspects of agitation jet devices according to embodiments of the present invention can provide more reliable, efficient and effective tablet agitation. More generally, agitation jet devices 150, 170 can provide relatively high thrust to the tablets T in the hopper chamber 120 with relatively low consumption of supplied high pressure gas.

The agitation jet devices 150, 170 may provide a number of additional performance advantages. The enlarged cross-section of the exit chamber 166C and/or the duct 123 ensures that the agitation flow FAF, FAR has an enlarged cross-section as compared to that of the jet slot 164. The enlarged cross-section of the agitation flow FAF, FAR provides a jet distribution better suited to agitating the tablets T.

By adding in the supplemental air flow F10 from the hopper subchamber 120B, the mass flow rate of the agitation flow FAF, FAR as applied to the tablets T is increased.

Advantageously, the agitation air flow FAF (or FAR) consists only of the gas from the gas source 136 and the supplemental air flow F10 drawn from the hopper chamber 120. Therefore, the agitation jet devices 150, 170 do not provide a flow path for air from the exterior or ambient environment surrounding the bin 100.

The agitation jet devices 150, 170 can be tuned or adjusted to provide the desired performance in view of other operating parameters (e.g., tablet size, supplied gas flow rate, etc.).

While the bin 100 has been illustrated and described herein with only one front agitation jet device 150 and one rear agitation jet device 170, fewer or greater numbers of front and rear agitation jet devices may be provided. For example, there may be two or more front agitation jet devices 150 and/or two or more rear agitation jet devices 170. According to some embodiments, the bin may include only a front agitation jet device or agitation jet devices 150 or, alternatively, only one or more rear agitation jet devices 170. The agitation jet devices may be arranged and configured in any suitable manner. For example, a row or rows of agitation jet devices may extend across the width of the floor 122.

While the bin 100 has been illustrated and described herein with the agitation jet device 150 being supplied from the same valve 142 and controlled in group fashion with the drive jet outlets 146 and the agitation jet device 170 being supplied from the same valve 144 and controlled in group fashion with the drive jet outlet 148, one or both of the agitation jet devices 150, 170 can be separately controlled from the associated jet outlets. For example, a further valve may be provided that controls the gas supply to the agitation jet device 150 independently of the jet outlets 146, whereby the tablets T may be agitated via the agitation jet device 150 prior to providing the dispensing draw via the jet outlets 146.

According to some embodiments, the opening 166B of the agitation jet device 150 and the corresponding opening of the agitation jet device 170 are each sized and shaped such that tablets of the smallest size and shape intended to be dispensed using the bin cannot fall through the openings 166C.

The controller 12 may include a local controller unique to each bin 100 that controls the valves 142, 144 of that bin 100.

Figure 15:
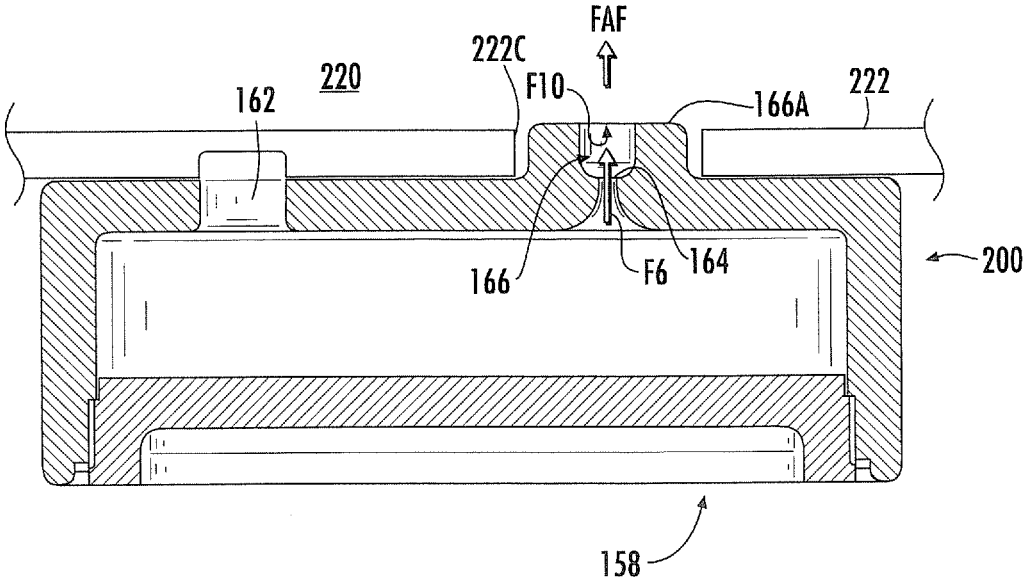
FIG. 15 is an enlarged, fragmentary, cross-sectional view of a bin according to an alternative construction and including the agitation jet device of FIG. 9.

With reference to FIG. 15, a bin 200 according to further embodiments of the present invention shown therein in enlarged, fragmentary cross-section. The bin 200 may correspond to the bin 100 except that the duct 123 is eliminated and the flange upper face 166A is mounted substantially flush with the agitation port 222C. The bin 200 operates in the same manner as the bin 100 except that supplemental air flow F10 is drawn from the hopper chamber 220 only into the exit chamber 166.

In the arrangement of the bin 200, the agitation jet device 150 may provide certain advantages in addition to those discussed above. Consider, for example, an alternative construction wherein a jet outlet is located in the floor surface 222 of the hopper chamber 220 without the provision of the exit chamber 166C to set off the jet outlet from the floor surface 222 and the tablets. That is, the jet outlet is substantially flush with the floor surface 222 and can contact the tablets in the hopper chamber 220. The gas flow responding to the juxtaposition of the rounded outer surface of a tablet opposite and adjacent the sharp corner of the agitation outlet 222C may generally and preferentially follow the tablet's rounded surface as a result of the Coanda effect. Due to the Coanda effect, a vacuum or low pressure region is established on or adjacent to the tablet's rounded surface. This low pressure region creates a vacuum force that tends to draw the tablet toward the agitation outlet 222C. As a result, the agitation outlet 222C can be blocked and may not effectively agitate the tablets in the hopper chamber 220. Agitation jet devices according to embodiments of the present invention such as the agitation jet devices 150, 170 can obviate or mitigate the tablet suction effect described above. By recessing the jet slot 164 from the floor surface 222, the tablets T are necessarily spaced apart from the jet slot 164 and the greater mass flow of the agitation flow FAF, FAR from the exit chamber 166C can prevent the occurrence of the Coanda effect induced suction.

Figure 16:
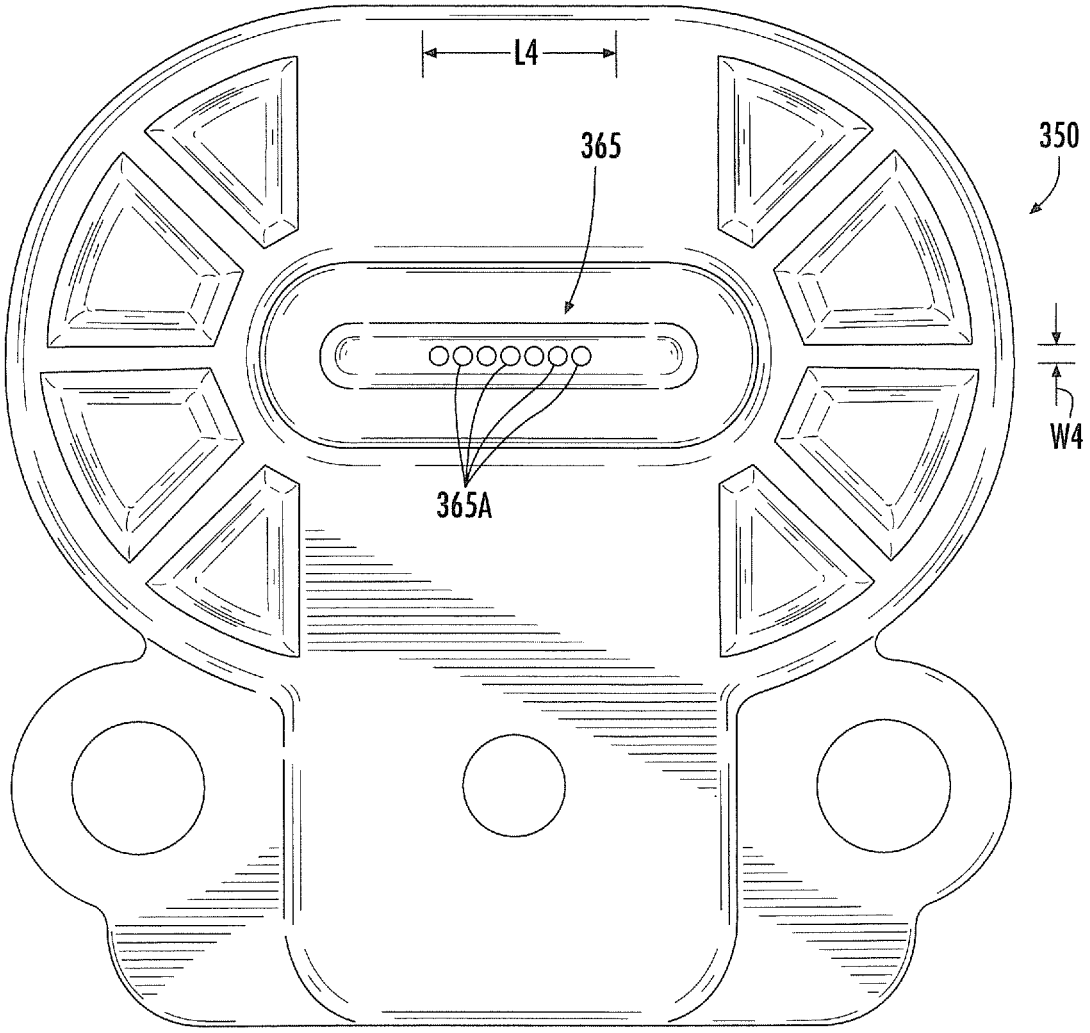
FIG. 16 is a top plan view of an agitation jet device according to further embodiments of the present invention.

With reference to FIG. 16, an agitation jet device 350 according to further embodiments of the present invention is show therein. The agitation jet device 350 may be constructed and used in the same manner as the agitation jet device 150, except as follows. The agitation jet device 350 may be used in place of the agitation jet device 150 or 170.

The agitation jet device 350 includes a set 365 of discrete jet holes 365A in place of the jet slot 364. The jet holes 365A are arranged in series in a line or row. According to alternative embodiments, the jet holes are arranged in a different arrangement (e.g., non-linear).

According to some embodiments, the set 365 has a diameter or width W4 in the range of from about 0.02 to 0.05 inch. According to some embodiments, the set 365 has a length L4 in the range of from about 0.1 to 0.5 inch. According to some embodiments, the ratio of the length L4 to the width W4 is at least about 6:1 and, according to some embodiments, in the range of from about 10:1 to 3:1. According to some embodiments, the collective length of the jet holes 365A to the collective width of the jet holes 365A is in the range of from about 0.1 to 0.2 inch. According to some embodiments, the collective area of the jet holes 365A is in the range of from about 0.001 $in^2$ to 0.003 $in^2$.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed is:

1. An apparatus for dispensing articles, the apparatus comprising:

a housing defining:

a hopper chamber to hold the articles;

a dispensing channel fluidly connected to the hopper chamber, the dispensing channel having an inlet and an outlet and defining a flow path therebetween; and an agitation outlet;

a gas source to provide a positive pressure supply gas flow having a first pressure, a first velocity and a first mass flow rate;

a drive mechanism to convey articles through the dispensing channel along the flow path; and an agitation jet device interposed and fluidly connected between the gas source and the agitation outlet, the agitation jet device including a feed opening to receive the supply gas flow and a jet opening to convert the supply gas flow to a pressurized agitation gas flow through the agitation outlet to agitate articles in the hopper chamber, wherein the agitation gas flow includes a supplemental gas flow that mixes with the supply gas flow, absorbs energy from the supply gas flow, and joins the supply gas flow to provide the agitation gas flow, the agitation gas flow having a second pressure less than the first pressure, a second velocity greater than the first velocity, and a second mass flow rate greater than the first mass flow rate.

2. The apparatus of claim 1 wherein the jet opening is an elongated slot.

3. The apparatus of claim 1 including a series of aligned jet openings.

4. The apparatus of claim 1 wherein the drive mechanism includes a drive jet outlet in the housing, and the gas source is also fluidly connected to the drive jet outlet to provide a pressurized drive jet gas flow through the drive jet outlet to convey articles through the dispensing channel along the flow path.

5. The apparatus of claim 1 configured to generate the drive jet gas flow and the agitation gas flow simultaneously.

6. The apparatus of claim 1 configured to generate the drive jet gas flow and the agitation gas flow simultaneously using the same gas source.

7. The apparatus of claim 1 wherein the supplemental gas flow is drawn from the hopper chamber.

8. The apparatus of claim 7 wherein the agitation gas flow consists essentially of the supply gas flow and the supplemental gas flow.

9. A method for dispensing articles using an apparatus including a housing defining a hopper chamber to hold the articles, a dispensing channel fluidly connected to the hopper chamber, and an agitation outlet, the apparatus further including a gas source, a drive mechanism, and an agitation jet device interposed and fluidly connected between the gas source and the agitation outlet, the method comprising:

providing a positive pressure supply gas flow from the gas source to a feed opening of the agitation jet device, the supply gas flow having a first pressure, a first velocity and a first mass flow rate;

using a jet opening of the agitation jet device, converting the supply gas flow to a pressurized agitation gas flow through the agitation outlet to agitate articles in the hopper chamber, wherein the agitation gas flow includes a supplemental gas flow that mixes with the supply gas flow, absorbs energy from the supply gas flow, and joins the supply gas flow to provide the agitation gas flow, the agitation gas flow having a second pressure less than the first pressure, a second velocity greater than the first velocity, and a second mass flow rate greater than the first mass flow rate; and conveying the articles through the dispensing channel along the flow path using the drive mechanism.

10. The method of claim 9 wherein the jet opening is an elongated slot.

11. The method of claim 9 wherein the agitation jet device includes a series of aligned jet openings.

12. The method of claim 9 wherein the drive mechanism includes a drive jet outlet in the housing, and including providing the supply gas flow from the gas source to the drive jet outlet to generate a pressurized drive jet gas flow through the drive jet outlet that conveys articles through the dispensing channel along the flow path.

13. The method of claim 12 including generating the drive jet gas flow and the agitation gas flow simultaneously.

14. The method of claim 12 including generating the drive jet gas flow and the agitation gas flow using the same gas source.

15. The method of claim 9 wherein the supplemental gas flow is drawn from the hopper chamber.

16. The method of claim 15 wherein the agitation gas flow consists essentially of the supply gas flow and the supplemental gas flow.

* * * * *